US005673330A

United States Patent [19]

Chang

[11] Patent Number: 5,673,330

[45] Date of Patent: Sep. 30, 1997

[54] MICROPHONE TRANSDUCER WITH NOISE REDUCING MEMBER

[76] Inventor: Ching-Lu Chang, No. 39, Lane 29, Shih-Chia Rd., Tung Dist., Taichung City, Taiwan

[21] Appl. No.: 555,169

[22] Filed: Nov. 8, 1995

[51] Int. Cl.[6] ..... H04R 25/00

[52] U.S. Cl. ..... 381/177; 381/168; 381/193

[58] Field of Search ..... 381/168, 169, 381/174, 177, 193, 202, 203, 204, 158, 205, 155, 190, 157; 181/171, 172, 157, 166, 158; 29/594, 609.1; 379/430, 433

[56] References Cited

U.S. PATENT DOCUMENTS

| | | | |
|---|---|---|---|
| 2,832,844 | 4/1958 | Matsuoka | 381/156 |
| 2,840,177 | 6/1958 | Schoengold | 181/172 |
| 4,117,275 | 9/1978 | Miyanaga et al. | 381/174 |
| 5,590,211 | 12/1996 | Chang | 381/193 |

*Primary Examiner*—Huyen D. Le

*Attorney, Agent, or Firm*—Harness, Dickey & Pierce, P.L.C.

[57] ABSTRACT

A microphone transducer includes a magnet, a yoke disposed around the magnet, an inner insulator provided between the magnet and the yoke, an outer insulator provided around the yoke, a voice coil provided around an upper portion of the magnet, and a diaphragm having a central convex portion and an annular convex portion which encircles the central convex portion. The central convex portion has a periphery which is attached to the voice coil. The annular convex portion has a periphery which is attached to the outer insulator. A noise reducing member includes a rigid annular mounting plate which is attached to the periphery of the annular convex portion of the diaphragm, and a flexible cushioning ring having a top side attached to the mounting plate and a bottom side attached to the outer insulator.

5 Claims, 6 Drawing Sheets

MICROPHONE TRANSDUCER WITH NOISE REDUCING MEMBER

BACKGROUND OF THE INVENTION

1. Field of the Invention

The invention relates to a microphone transducer, more particularly to a microphone transducer which is capable of minimizing the adverse effects of noise so as to permit the production of a high quality signal output.

2. Description of the Related Art

Microphones can be classified into several categories depending upon the transducer principle which is employed. Referring to FIG. 1, the electroacoustic transducer 10 of a conventional dynamic microphone is shown to comprise a magnet 11 and a yoke 12 disposed around the magnet 11. An inner insulator 13 is provided between the magnet 11 and the yoke 12. An outer insulator 14 is provided around the yoke 12. The inner insulator 13 has an upper portion formed with an annular recess which receives a voice coil 16 therein, thereby providing the voice coil 16 around the magnet 11. The voice coil 16 is disposed movably in a magnetic field generated between the opposite poles of the magnet 11. A diaphragm 15 has a central convex portion and an annular convex portion which encircles the central convex portion. The central convex portion has a periphery attached to the voice coil 16. The annular convex portion has a periphery attached to the outer insulator 14. The outer insulator 14 is disposed within a transducer housing 18. A protective cover 17 is provided on the outer insulator 14 above the diaphragm.

In the dynamic microphone, the compression and rarefaction of sound waves actuate the diaphragm 15, thus causing movements in the voice coil 16 to create a varying magnetic flux. This varying flux, together with the magnetic field that is generated by the magnet 11, produces electrical signals which are provided to an amplifier (not shown) and then to a speaker (not shown).

The main drawback of the transducer 10 of the conventional dynamic microphone is that it is highly susceptible to noise. Referring to FIG. 2, the transducer 10 is shown to be installed on a top end of a microphone housing 30 and is enclosed by a perforated cap 31. When the microphone is in use, there is friction between the hand of the user and the microphone housing 30, thereby resulting in noise. This noise is transmitted to the diaphragm 15 and to the voice coil 16 via the transducer housing 18 and the outer insulator 14, thereby affecting adversely the quality of signal output of the transducer 10.

SUMMARY OF THE INVENTION

Therefore, the object of the present invention is to provide an improved microphone transducer which is capable of minimizing the adverse effects of noise so as to permit the production of a high quality signal output.

More particularly, the object of the present invention is to provide a microphone transducer with a noise reducing member to minimize the adverse effects of friction between the microphone housing and the hands of the user so as to permit the production of a high quality signal output.

Accordingly, the microphone transducer of the present invention includes a magnet, a yoke disposed around the magnet, an inner insulator provided between the magnet and the yoke, an outer insulator provided around the yoke, a voice coil provided around an upper portion of the magnet, and a diaphragm having a central convex portion and an annular convex portion which encircles the central convex portion. The central convex portion has a periphery which is attached to the voice coil. The annular convex portion has a periphery which is attached to the outer insulator. A noise reducing member mounts the periphery of the annular convex portion of the diaphragm to the outer insulator.

In one embodiment, the noise reducing member includes a rigid annular mounting plate which is attached to the periphery of the annular convex portion of the diaphragm, and a flexible cushioning ring having a top side attached to the mounting plate and a bottom side attached to the outer insulator.

In another embodiment, the noise reducing member includes a flexible first cushioning ring which is attached to the periphery of the annular portion of the diaphragm, a rigid annular mounting plate which has a top side attached to the first cushioning ring and a bottom side, and a second flexible cushioning ring which has a top side attached to the bottom side of the mounting plate and a bottom side attached to the outer insulator.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
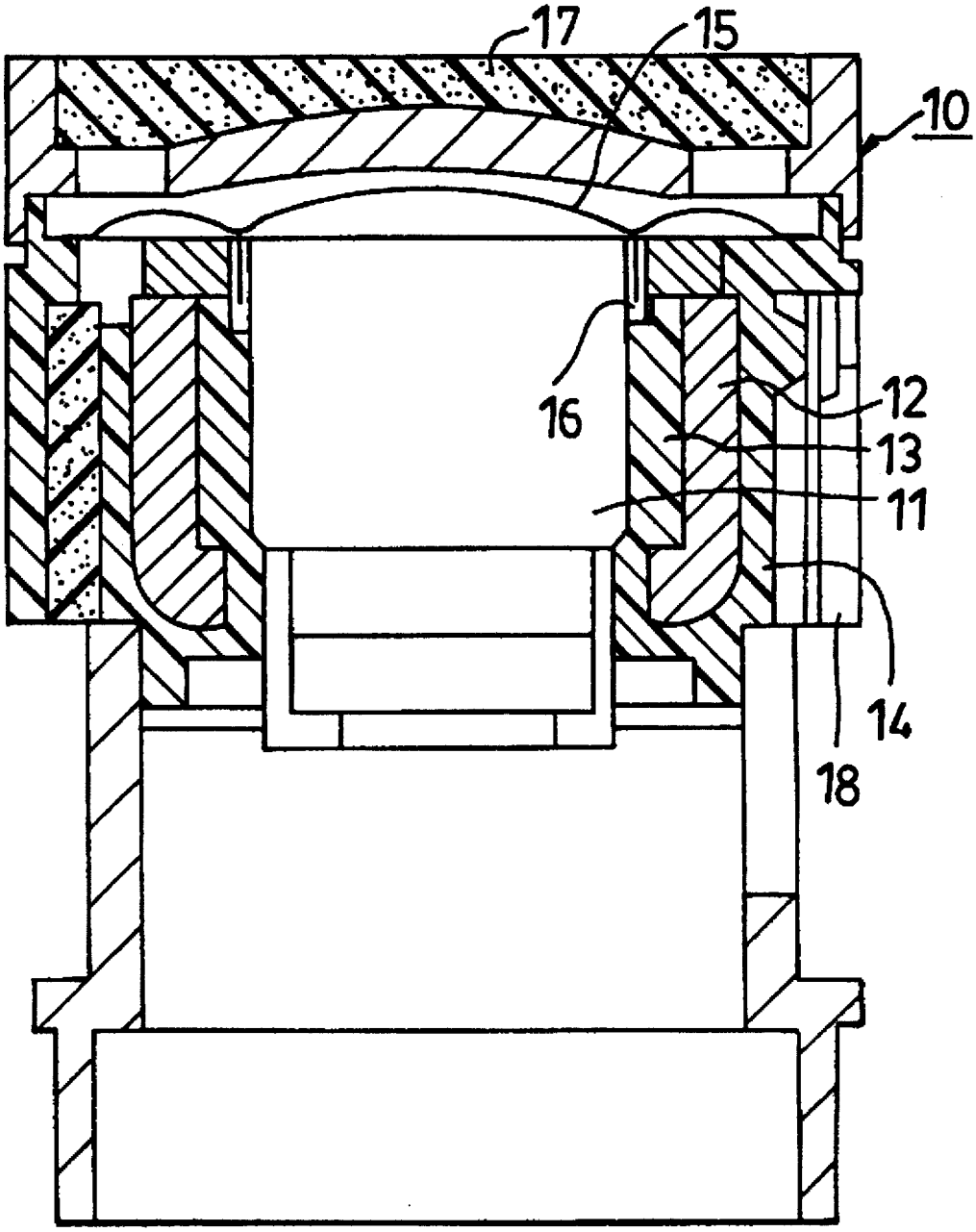
FIG.1 PRIOR ART
FIG. 1 is a schematic sectional view of the microphone transducer of a conventional dynamic microphone.
Figure 2:
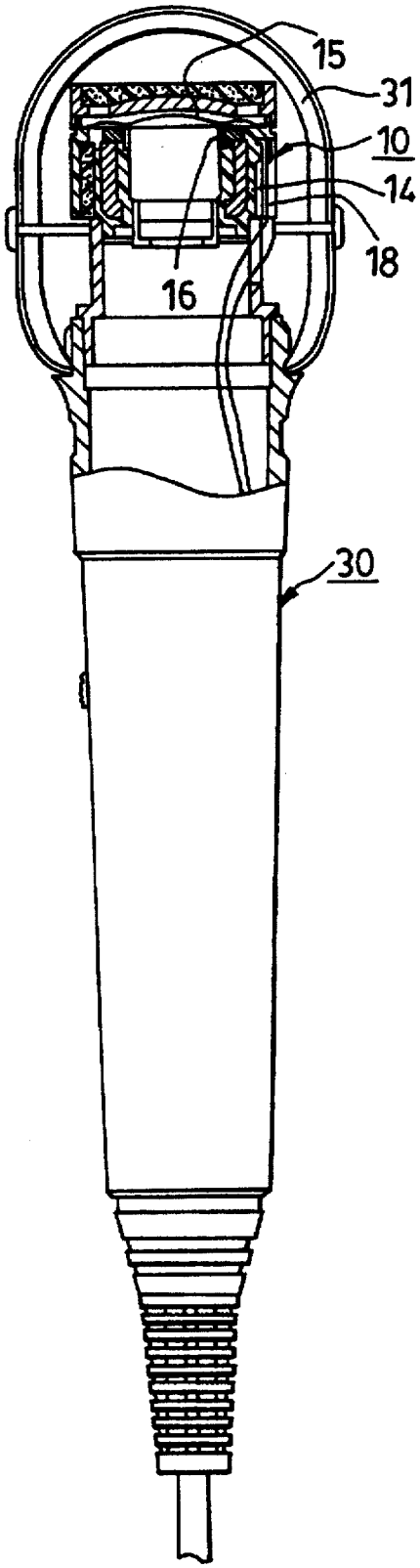
FIG.2 PRIOR ART
FIG. 2 is a schematic sectional view of the conventional dynamic microphone with the microphone transducer of FIG. 1 mounted therein.
Figure 3:
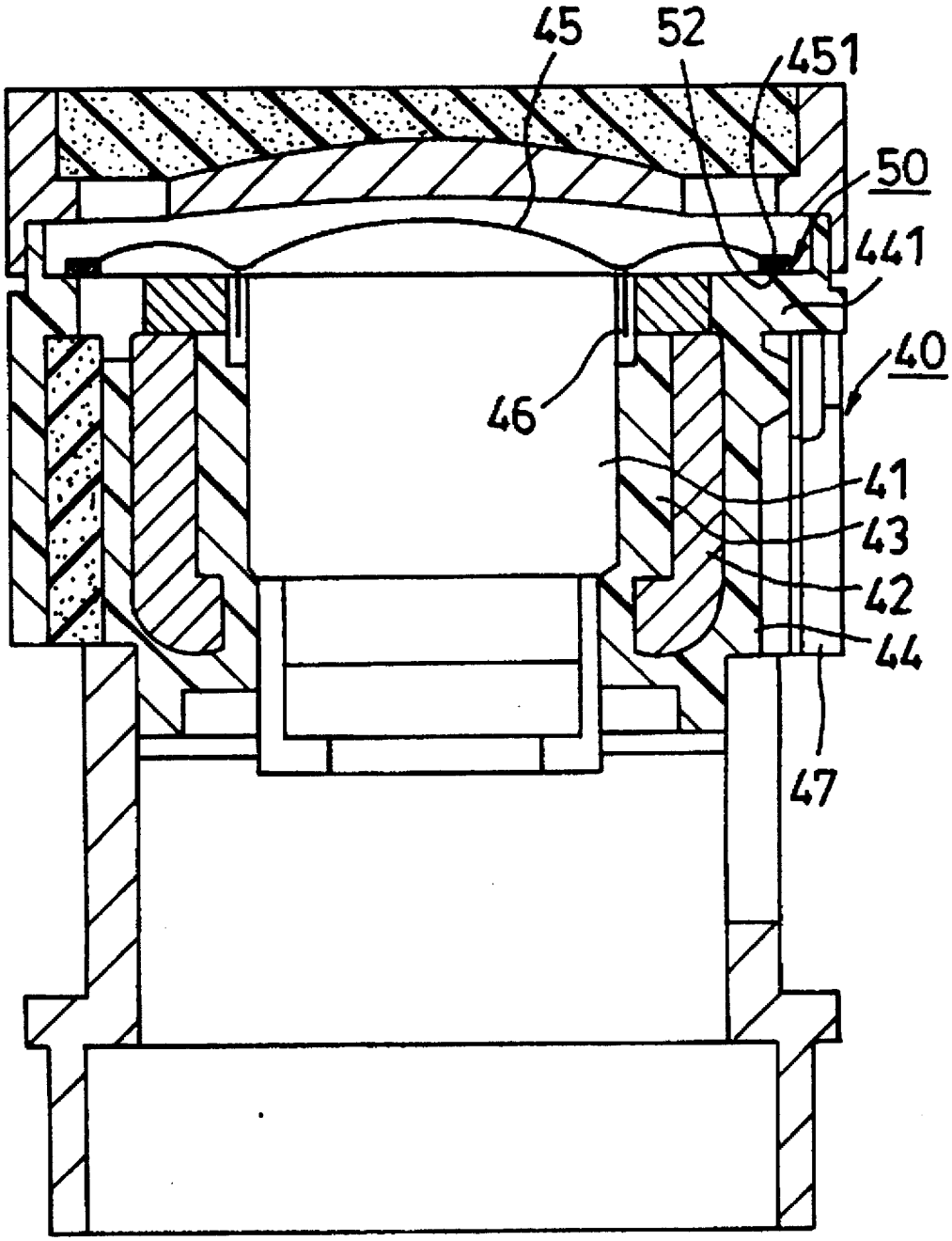
FIG. 3 is a schematic sectional view of the first preferred embodiment of a microphone transducer for a dynamic microphone in accordance with the present invention.

Referring to FIG. 3, the first preferred embodiment of a microphone transducer 40 according to the present invention is shown to comprise a magnet 41 and a yoke 42 disposed around the magnet 41. An inner insulator 43 is provided between the magnet 41 and the yoke 42. An outer insulator 44 is provided around the yoke 42. The inner insulator 43 has an upper portion formed with an annular recess which receives a voice coil 46 therein, thereby providing the voice coil 46 around the magnet 41. The voice coil 46 is disposed movably in a magnetic field generated between the opposite poles of the magnet 41. A diaphragm 45 has a central convex portion and an annular convex portion which encircles the central convex portion. The central convex portion has a periphery attached to the voice coil 46. The annular convex portion has a periphery 451 which is attached to a top portion 441 of the outer insulator 44. The outer insulator 44 is disposed within a transducer housing 47.

Figure 4:
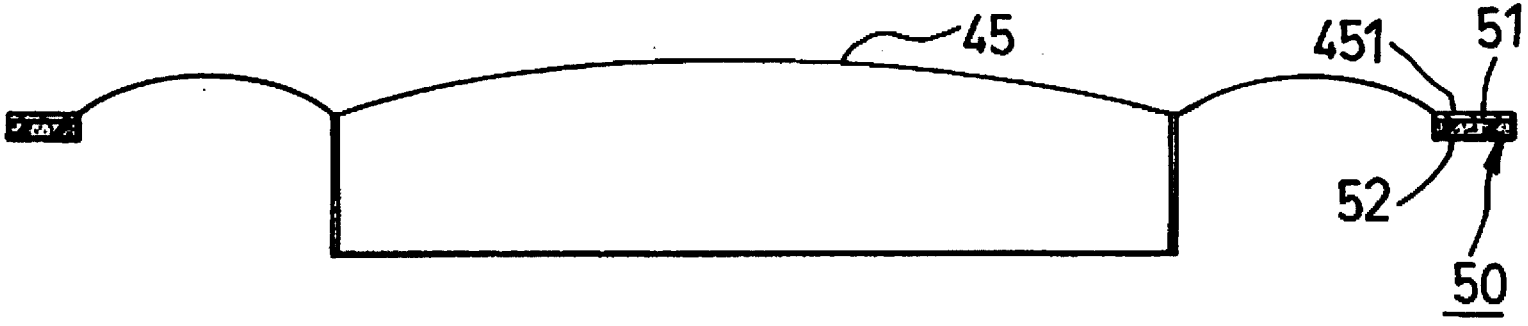
FIG. 4 is a sectional view illustrating the connection between a diaphragm and a noise reducing member of the first preferred embodiment.

The microphone transducer 40 of this invention is characterized by a noise reducing member 50 which mounts the periphery 451 of the annular convex portion of the diaphragm 45 to the top portion 441 of the outer insulator 44. Referring to FIG. 4, the noise reducing member 50 of this embodiment includes a rigid annular mounting plate 51 which is attached directly to the periphery 451 of the annular convex portion of the diaphragm 45 by means of an adhesive. Preferably, the mounting plate 51 is made of stainless steel. A flexible cushioning ring 52, which is similar in size and shape to the mounting plate 51, has a top side attached adhesively to a bottom side of the mounting plate 51. Preferably, the cushioning ring 52 is made of a flexible plastic foam, such as PVC foam. The cushioning ring 52 further has a bottom side attached to the top portion 441 of the outer insulator 44, as shown in FIG. 3. Thus, the cushioning ring 52 is capable of absorbing noise that is transmitted from the microphone housing (not shown) to the outer insulator 44 to minimize the adverse effects of such noise on the movement of the diaphragm 45. Since the cushioning ring 52 is made of a flexible material and since the diaphragm 45 is formed from a thin film, the mounting plate 51 is needed to reinforce the connection between the diaphragm 45 and the outer insulator 44.

Figure 5:
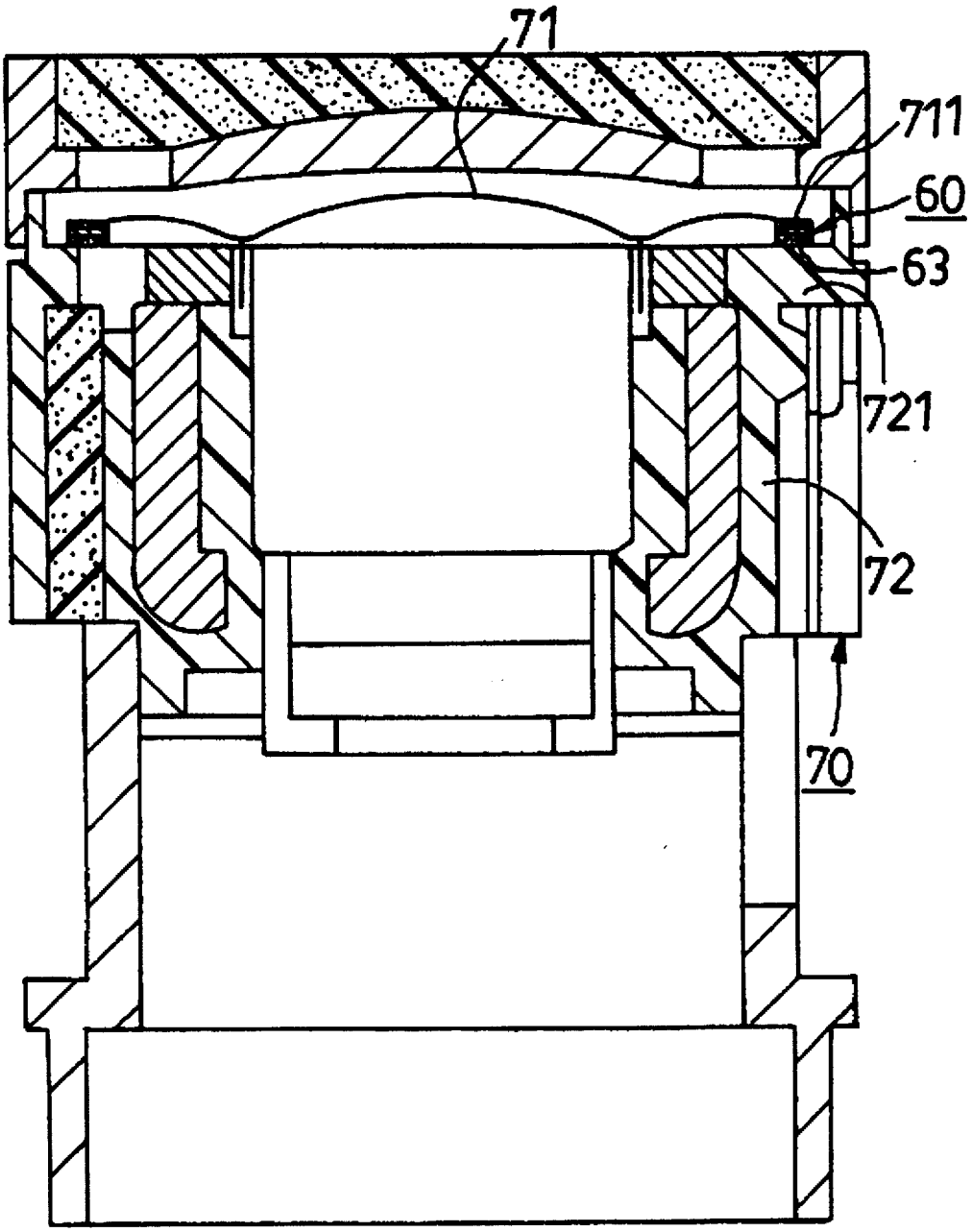
FIG. 5 is a schematic sectional view of the second preferred embodiment of a microphone transducer for a dynamic microphone in accordance with the present invention.
Figure 6:
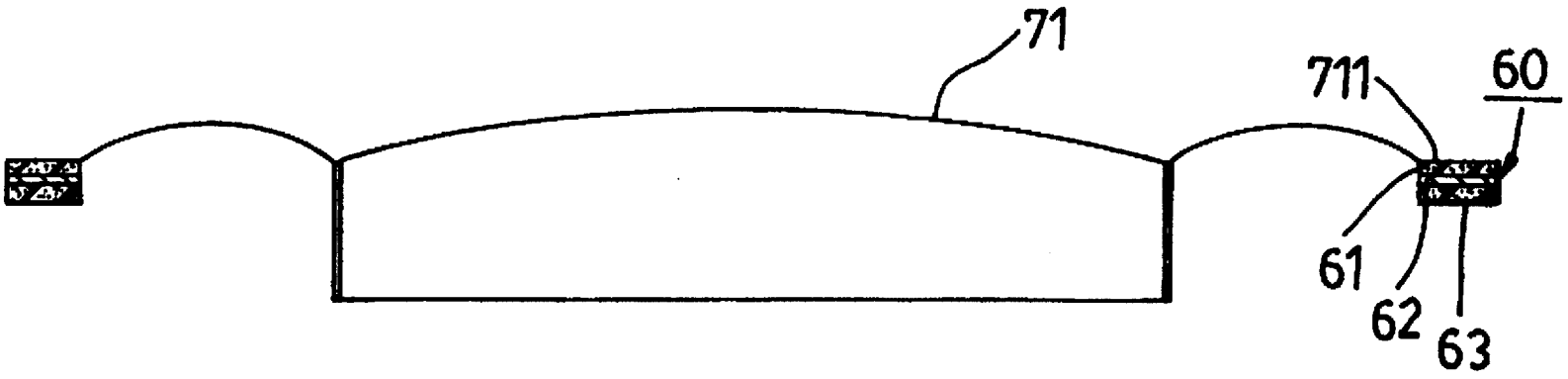
FIG. 6 is a sectional view illustrating the connection between a diaphragm and a noise reducing member of the second preferred embodiment.

Referring to FIGS. 5 and 6, the second preferred embodiment of a microphone transducer 70 according to the present invention is shown to similarly comprise a noise reducing member 60 for mounting the periphery 711 of the annular convex portion of a diaphragm 71 to the top portion 721 of an outer insulator 72. The noise reducing member 60 includes a first cushioning ring 61 which is attached directly to the periphery 711 of the annular convex portion of the diaphragm 71 by means of an adhesive, a rigid annular mounting plate 62 which has a top side attached adhesively to a bottom side of the first cushioning ring 61, and a second cushioning ring 63 which has a top side attached adhesively to a bottom side of the mounting plate 62. Preferably, the first and second cushioning rings 61, 63 are made from a flexible plastic foam, such as PVC foam. The second cushioning ring 63 further has a bottom side attached adhesively to the top portion 721 of the outer insulator 72, as shown in FIG. 5. The cushioning rings 61, 63 further enhance the capability of the noise reducing member 60 to absorb noise that is transmitted from the microphone housing (not shown) to the outer insulator 72.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A handheld dynamic microphone including a housing, a microphone transducer disposed within said housing and including a magnet, a yoke disposed around the magnet, an inner insulator provided between the magnet and the yoke, an outer insulator provided around the yoke, a voice coil provided around an upper portion of the magnet, and a diaphragm having a central convex portion and an annular convex portion which encircles the central convex portion, the central convex portion having a periphery which is attached to the voice coil, the annular convex portion having a periphery which is attached to the outer insulator, wherein the improvement comprises:

a noise reducing member for reducing noise signals generated by friction between the hand of a user of said microphone and said housing of said microphone, said noise reducing member including a rigid annular mounting plate having first and second sides, said first side being attached to the periphery of the annular convex portion of the diaphragm, and a first flexible cushioning ring having a top side attached to said second side of said mounting plate and a bottom side attached to the outer insulator.

2. The microphone transducer as claimed in claim 1, wherein the first flexible cushioning ring is made of a flexible plastic foam.

3. A handheld dynamic microphone as set forth in claim 1 wherein said rigid annular mounting plate is attached to said periphery of said annular convex portion by means of a second flexible cushioning ring having a first surface attached to said first side of said mounting plate and a second surface attached to said periphery of said annular convex portion.

4. A handheld dynamic microphone including a housing, a microphone transducer disposed within said housing and including a magnet, a yoke disposed around the magnet, an inner insulator provided between the magnet and the yoke, an outer insulator provided around the yoke, a voice coil provided around an upper portion of the magnet, and a diaphragm having a central convex portion and an annular convex portion which encircles the central convex portion, the central convex portion having a periphery which is attached to the voice coil, the annular convex portion having a periphery which is attached to the outer insulator, wherein the improvement comprises:

a noise reducing member for reducing noise signals generated by friction between the hand of a user of said microphone and said housing of said microphone, said noise reducing member including a flexible first cushioning ring which is attached to the periphery of the annular portion of the diaphragm, a rigid annular mounting plate which has a top side attached to the first cushioning ring and a bottom side, and a second flexible cushioning ring which has a top side attached to the bottom side of the mounting plate and a bottom side attached to the outer insulator.

5. The microphone transducer as claimed in claim 4, wherein the first and second cushioning rings are made from a flexible plastic foam.

* * * * *